US005701616A

United States Patent [19]

Rosenquist

[11] Patent Number: 5,701,616

[45] Date of Patent: Dec. 30, 1997

[54] LOAD-BEARING SCAFFOLD FOR BEDS AND THE LIKE

[76] Inventor: Terry L. Rosenquist, 835 Hewitt St., Hastings, Nebr. 68901

[21] Appl. No.: 406,741

[22] Filed: Mar. 20, 1995

[51] Int. Cl.[6] ..... A47C 19/20

[52] U.S. Cl. ..... 5/8; 5/127; 5/131

[58] Field of Search ..... 5/9.1, 127, 131, 5/8, 200.1, 201, 184, 185; 135/96, 97, 143, 901, 909, 139, 141, 142, 120.3, 133, 135; 182/150

[56] References Cited

U.S. PATENT DOCUMENTS

| | | | |
|---|---|---|---|
| 631,962 | 8/1899 | Lein . | |
| 665,535 | 1/1901 | Lein . | |
| 669,175 | 3/1901 | Lein . | |
| 822,592 | 6/1906 | Dowling . | |
| 860,941 | 7/1907 | Rodrigues . | |
| 958,895 | 5/1910 | Rodrigues . | |
| 982,997 | 1/1911 | Russell . | |
| 1,001,946 | 8/1911 | Gumm . | |
| 1,066,668 | 7/1913 | Sisbower | 5/130 |
| 1,089,545 | 3/1914 | Gosso . | |
| 1,195,637 | 8/1916 | Anderson . | |
| 1,253,549 | 1/1918 | Weaver . | |
| 1,268,113 | 6/1918 | Gosso | 135/96 |
| 1,291,758 | 1/1919 | Buck | 5/9.1 |
| 1,325,320 | 12/1919 | Gosso . | |
| 1,349,962 | 8/1920 | Janson et al. . | |
| 1,677,844 | 7/1928 | Patton | 5/127 |
| 1,732,154 | 10/1929 | Cunningham | 5/127 |
| 1,961,915 | 6/1934 | Salmen | 135/96 |
| 3,071,204 | 1/1963 | Piltingsrud | 182/27 |
| 3,215,387 | 11/1965 | Thompson et al. . | |
| 3,376,879 | 4/1968 | Huddle | 135/97 |
| 3,858,254 | 1/1975 | Coomes | 5/8 |
| 4,056,327 | 11/1977 | Daus | 135/409 |
| 4,084,276 | 4/1978 | Trexler, Jr. et al. | 5/118 |
| 4,192,028 | 3/1980 | Knoke | 5/200.1 |
| 4,256,300 | 3/1981 | Boucher | 482/36 |
| 4,263,683 | 4/1981 | Knoke | 5/200.1 |

FOREIGN PATENT DOCUMENTS

| | | |
|---|---|---|
| 302245 | 10/1932 | Italy . |
| 81953 | 6/1953 | Norway . |

*Primary Examiner*—Rodney M. Lindsey
*Assistant Examiner*—Fredrick Conley

[57] ABSTRACT

A load-bearing scaffold for placement on the floor of a room for supporting articles includes first and second generally upright load-bearing support structures each having upper sections and bases and a generally horizontal beam having opposite ends, one of the ends removably mounted to one each of the first and second support structures at the upper sections thereof. At least one generally horizontal platform is removably mounted on one of the first and second support structures intermediate the horizontal beam and base of the support structure. The platform includes inner and outer sides, the outer side removably mounted to one of the first and second support structures. Finally, at least one tension member extends between and is connected to the horizontal beam and the platform means, the tension member depending adjacent the outer side of the platform whereby the platform is suspended above the floor of a room.

12 Claims, 4 Drawing Sheets

LOAD-BEARING SCAFFOLD FOR BEDS AND THE LIKE

BACKGROUND OF THE INVENTION

1. Technical Field

This invention relates to an apparatus for suspending a bed frame above the ground and, more particularly, to a load-bearing scaffold for placement on the floor of the room for supporting articles which includes two load-bearing support structures, a generally horizontal beam extending between the top sections of each load-bearing support structure and at least one generally horizontal platform connected at one side to one of the support structures and at the other side to a tension member extending downwards from the horizontal beam and connected to the inner side of the platform.

2. Description of the Prior Art

Load bearing scaffolds are well known in the construction arts. Such scaffolds are generally adapted for supporting workmen, construction equipment and building materials.

Also known are bunks and berths adapted to provide sleeping accommodations for passengers, military personal, students or small children. These apparati are often adapted to be supported from poles anchored to the floor and ceiling of a room. Examples of this general species are disclosed in Lein, U.S. Pat. No. 665,535 and Nystrom, Norwegian 81953.

Also known to the art are bunks or berths adapted to be supported by anchoring the bunk or berth to a wall. Examples of this general species are disclosed in Lein, U.S. Pat. No. 669,175 and Rodriguez, U.S. Pat. No. 860,941.

Inventions of this type are unsuitable for the present objects since their installation requires that they become room fixtures. Additionally, such bunks or berths require the dedication of otherwise useful floor space.

Free standing bunk beds are also known to the bunk and berth art. Examples of this type of bed may be found in Lein, U.S. Pat. No. 631,962 and Anderson, U.S. Pat. No. 1,195, 637. Bunks or berths of this type are also incapable of fulfilling the objects of the present invention in that they require otherwise livable space to be dedicated solely to their use.

3. Objects of the Invention

Many educational institutions provide dormitories in order to accommodate students who are required to live on campus. Dormitories are generally multi-story buildings having a central elevator and stairway corridor. On either side of these central areas is a hallway having a plurality of small rooms located on either side of the hallway.

Each room has a small closet and is usually furnished with two single beds, two desks, two lamps, two chairs and a dresser or bureau. Even though each room contains a minimal amount of furniture, the rooms are small and thus space is at a premium.

Since the rooms are small, it is difficult for two people to live comfortably within the room. The problem becomes even more acute when the trappings of a comfortable lifestyle are incorporated into the room, such as a stereo, television, small refrigerator or furniture such as chairs, tables or sofas.

Students desiring a more livable environment often remove their beds or make the existing two single beds into a lower and upper berth bunk bed. Alternatively, students will build structures to suspend the mattresses above the ground level. Of course, relatively few of the students involved in building such a structure will have previous construction experience, and therefore the resulting structure may be prone to failure. There is therefore a need for a sturdily constructed load-bearing scaffold which will support a bed frame in a suspended position while occupying a minimal amount of floor space.

Many of the bunks and berths described in the prior art rely on contact with wall surfaces to retain the scaffold in place within the room. Obviously, such contact can damage the wall surface, particularly if the wall surface adjacent the scaffold is of the drywall type. There is a need for a load-bearing scaffold which will support a bed frame in a suspended position while generally not contacting wall surfaces.

Therefore, an object of the present invention is to provide an improved load-bearing scaffold for beds and the like.

Another object of the present invention is to provide a load-bearing scaffold that does not require the scaffold to be attached to the room infrastructure or superstructure.

Another object of the present invention is to provide a load-bearing scaffold that will not damage room surfaces.

Another object of the present invention is to provide a load-bearing scaffold which includes a pair of generally upright support structures connected by a single horizontal beam extending between the top sections of each of the support structures, and at least one generally horizontal platform mounted on one of the support structures between the horizontal beam and the base of the support structure, the platform being supported by connection to a tension member extending between the horizontal beam and the inner side of the platform.

Another object of the present invention is to provide a load-bearing scaffold that is low in cost and easy to manufacture.

Another object of the present invention is to provide a load-bearing scaffold that is safe to use and durable in construction.

Another object of the present invention is to provided a load-bearing scaffold that is capable of supporting beds, desks, shelves and the like.

Finally, an object of the present invention is to provide load-bearing scaffold which may be used in a variety of rooms and will not cause damage to room surfaces due to frictional contact between the scaffold and the room surfaces.

SUMMARY OF THE INVENTION

The present invention provides a load-bearing scaffold for placement on the floor of a room for supporting articles including first and second generally upright load-bearing support structures each having upper sections and bases and a generally horizontal beam having opposite ends. One of the ends of the horizontal beam is removably mounted to the upper section of the first support structure and the other end of the horizontal beam is removably mounted to the upper section of the second support structure. At least one generally horizontal platform is removably mounted on one of the first and second support structures intermediate the horizontal beam and the base of the support structure. Each platform includes inner and outer sides, the outer side removably mounted to one of the first and second support structures. Finally, at least one tension member extends between and is connected to the horizontal beam and the platform, the tension member depending adjacent the outer side of the platform whereby the platform is suspended above the floor of a room.

The present invention thus provides a substantial improvement over those devices found in the prior art. Because the scaffold does not contact the side walls of the room, damage to the side walls of the room is eliminated. Furthermore, as the scaffold of the present invention is free-standing, all of the weight of the scaffold is transferred to the floor surface, which is designed to support such a weight. It has been found that if weight is transferred to the side walls of the room, the pad in contact with the wall will damage the wall, particularly if the wall is constructed of drywall. Additionally, the use of a single horizontal beam extending across the top section of the scaffold allows for simpler construction and more manageable assembly of the apparatus. It is therefore seen that the present invention provides a substantial advantage over those devices found in the prior art.

DESCRIPTION OF THE PREFERRED EMBODIMENT

Figure 1:
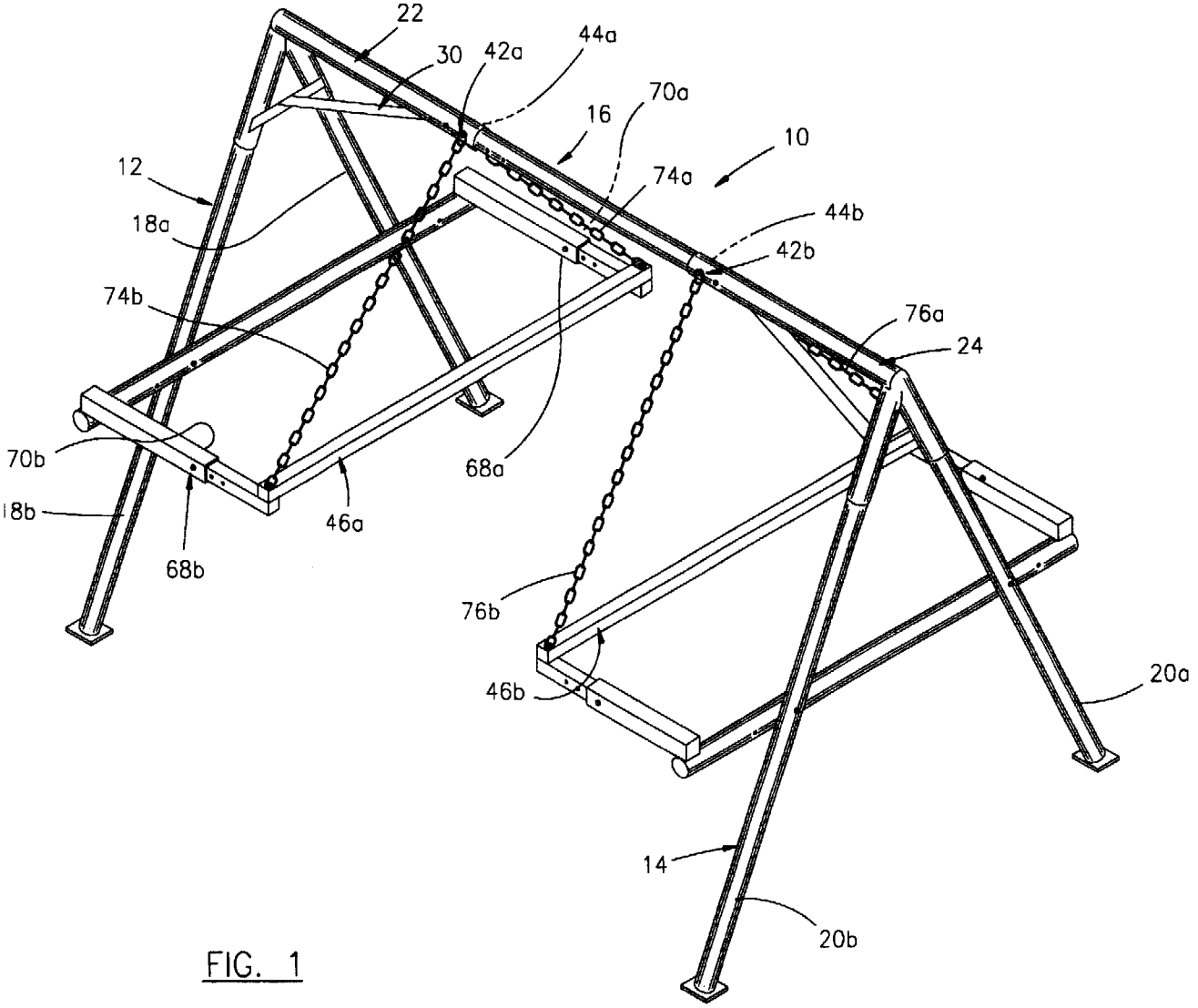
FIG. 1 is a perspective view of the load-bearing scaffold of the present invention.
Figure 2:
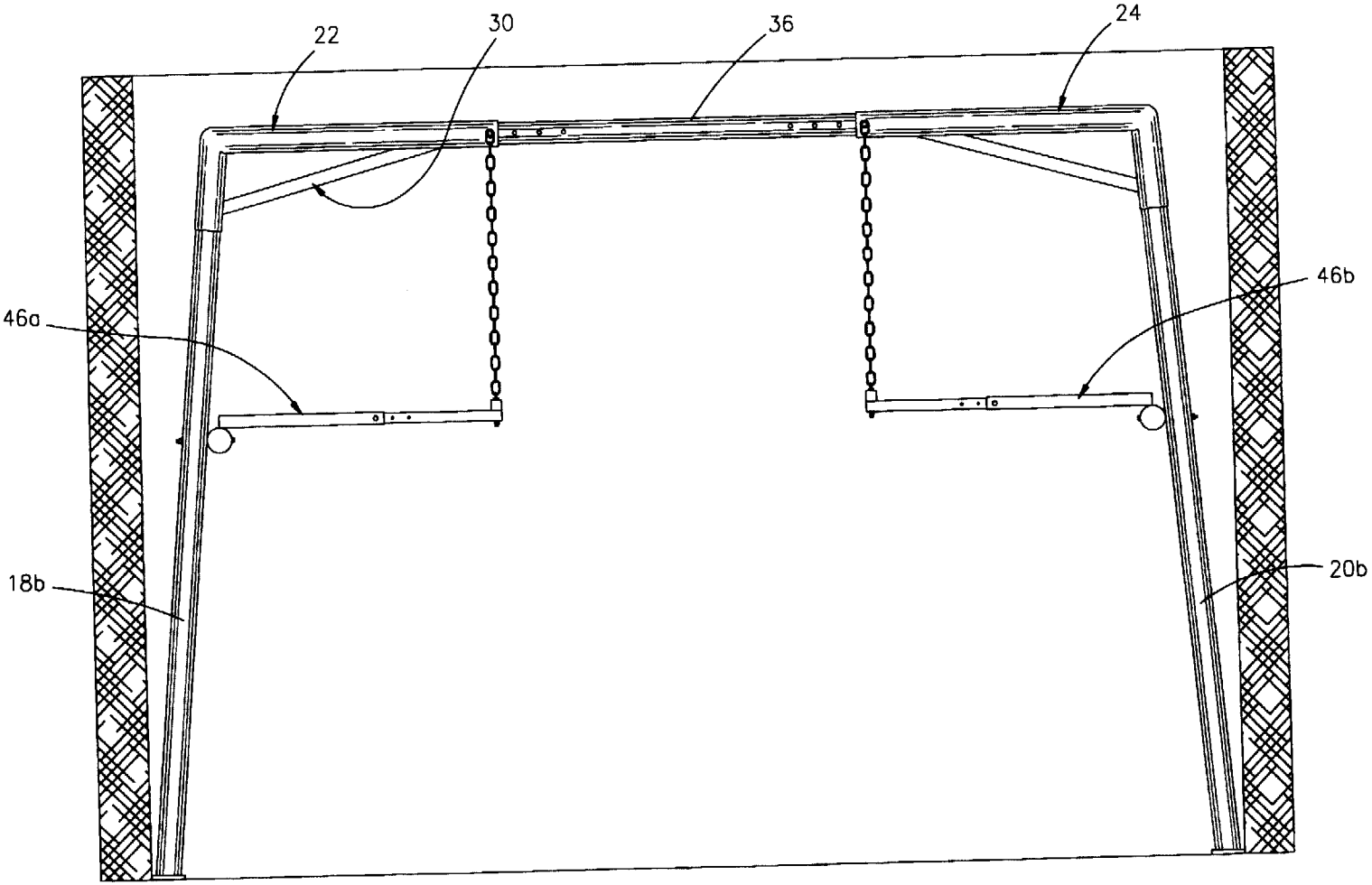
FIG. 2 is a side elevational view of the scaffold of the present invention.
Figure 3:
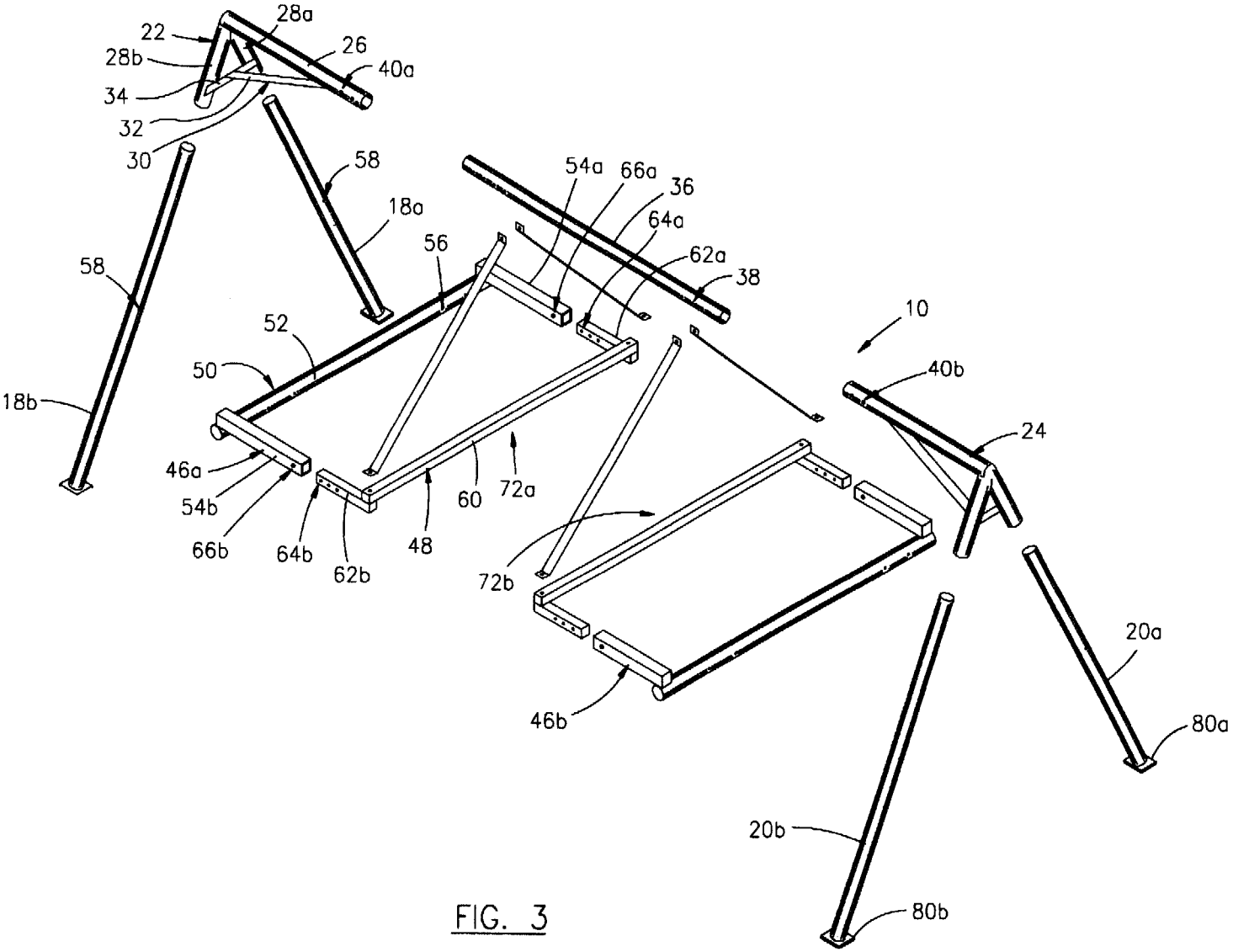
FIG. 3 is an exploded perspective view of the scaffold showing the various elements of the scaffold.

The load-bearing scaffold 10 of the present invention is best shown in FIGS. 1–3 as including a first support structure 12 and a second support structure 14 connected by a generally horizontal beam 16.

Figure 4:
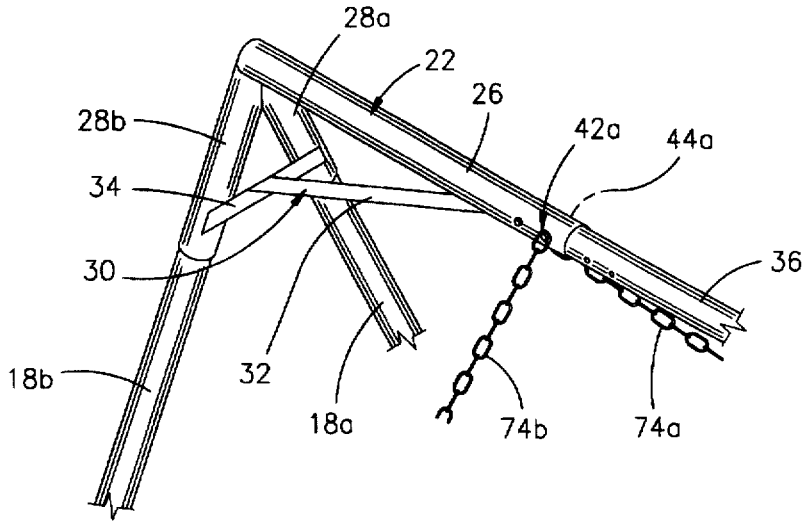
FIG. 4 is a partial detailed perspective view of the corner connection section of the present invention.

As shown best in FIG. 1, each of the first and second support structures 12 and 14 include ground-engaging legs, support structure 12 including legs 18*a* and 18*b* and second support structure 14 including legs 20*a* and 20*b*. Each of the support structures 12 and 14 further include one corner connector 22 and 24, as best shown in FIGS. 3 and 4. It is preferred that the legs 18*a* and 18*b*, 20*a* and 20*b* and corner connectors 22 and 24 all be constructed of tubular rolled steel or aluminum, similar to that used in construction of playground equipment.

In further discussion of the structure of the present invention, description will be limited to the first support structure 12 and elements thereof, although it is to be understood that the second support structure 14 is substantially identical to the first support structure 12.

FIG. 4 exhibits corner connector 22 which includes the generally horizontal beam connection sleeve 26 and a pair of downwardly depending leg connection sleeves 28*a* and 28*b*. The leg connection sleeves 28*a* and 28*b* and beam connection sleeve 26 are connected as shown in FIG. 4 with the angle between the beam connection sleeve 26 and leg connection sleeves 28*a* and 28*b* being at least and preferably slightly greater than ninety degrees. This results in the support structure 12 being slightly tilted from vertical, as best shown in FIG. 2. The leg connection sleeves 28*a* and 28*b* form a V-shape and are adapted to slidably accept the legs 18*a* and 18*b* such that a generally sturdy V-shaped support structure 12 may be formed.

To further rigidify the corner connector 22, a steel T-brace 30 is preferably provided, the stem 32 of the T-brace 30 connected to the underside of the beam connection sleeve 26 and the opposite ends of the cross bar 34 of the T-brace 30 each connected to one of the leg connection sleeves 28*a* and 28*b*. The T-brace 30 thus provides additional structural rigidity to the corner connector 22.

As best shown in FIG. 3, a center support beam 36 extends between and is connected to each of the corner connectors 22 and 24. It is preferred that the center support beam 36 be formed of rolled steel similar to the legs 18*a* and 18*b*, 20*a* and 20*b* on the first and second support structures 12 and 14. It is preferred that the center support beam 36 have an outer diameter which is slightly less than the inner diameter of the beam connection sleeve 26 of corner connector 22 such that the center support beam 36 may be slidably housed within the beam connection sleeve 26. Of course, the opposite ends of center support beam 36 may simply be pinched to allow the ends to fit within the corner connectors 22 and 24 if so desired. The connection to corner connector 24 is accomplished in the same manner.

For securing the center support beam 36 within each of the corner connectors 22 and 24, a set of adjustment holes 38 are formed transversely through the center support beam 36. A similar transverse hole 40*a* and 40*b* is formed adjacent the inner end of each of the corner connectors 22 and 24. The center support beam 36 is secured to each of the corner connectors 22 and 24 in the following manner: The center beam 36 is slid into the corner connector 22 and corner connector 24 such that each adjustment hole 40*a* and 40*b* in the corner connectors 22 and 24 is aligned with one of the adjustment holes 38 in the center support beam 36. A pair of bolts 42*a* and 42*b* are then extended through the adjustment holes 40*a* and 4O*b* in the corner connectors 22 and 24 and through the respective aligned adjustment hole 38, thus securing the center support beam 36 within each of the corner connectors 22 and 24. To secure the bolts 42*a* and 42*b*, nuts 44*a* and 44*b* are threaded onto the end of each bolt thus securing the bolt within the respective adjustment hole 40*a* and 4O*b*. Additionally, due to the plurality of adjustment holes 38 in the center support beam 36, the distance between the first and second support structures 12 and 14 may be adjusted to fit various sized rooms. Of course, the same result may be achieved by substituting a center support beam 36 of different length rather than providing a plurality of adjustment holes 38, however, it is preferred that a single center support beam 36 having a plurality of adjustment holes 38 be provided.

The bed support platforms 46*a* and 46*b* are best shown in FIGS. 1 and 3. It is preferred that each of the bed support platforms 46*a* and 46*b* be substantially identical, and therefore the following description of bed support platform 46*a* will be understood to be applied to bed support platform 46*b*. Bed support platform 46*a* is preferably constructed of inner and outer interfitting platform sections 48 and 50. Outer platform section 50 includes an outer side bar 52 to which are connected end bars 54*a* and 54*b*. The outer side bar 52 is preferably a rolled steel tube, whereas the end bars 54*a* and 54*b* are preferably square tubes extending perpendicular to the outer side bar 52 and generally horizontal therefrom. As shown best in FIG. 3, the outer side bar 52 further includes transverse mounting holes 56 which are formed to allow alignment of the mounting holes 56 with mounting holes 58 formed in the first support structure 12, specifically in the legs 18*a* and 18*b*. By providing a plurality of mounting holes 56 in the outer side bar 52 and a plurality of mounting holes 58 in the legs 18*a* and 18*b*, the height at which the outer side bar 52 is attached to the legs 18*a* and 18*b* may be adjusted.

Inner platform section 48 includes an inner side bar 60 to which is attached a pair of end bars 62*a* and 62*b*, as shown in FIG. 3. It is preferred that the inner side bar 60 be constructed as either a rolled steel tube or a square steel tube, depending upon which type of tube is preferred by the manufacturer. The end bars 62*a* and 62*b* extend perpendicularly from the inner side bar 60 and generally horizontal therefrom. It is preferred that the end bars 62*a* and 62*b* be constructed of square metal tubing which has an outer thickness which is slightly less than the inner width of end bars 54*a* and 54*b*. In this manner, end bars 62*a* and 62*b* may be slidably received within end bars 54*a* and 54*b*, as shown in FIG 1. To secure end bars 62*a* and 62*b* within end bars 54*a* and 54*b*, end bars 62*a* and 62*b* include a plurality of adjustment holes 64*a* and 64*b* which extend transversely through each of the end bars 62*a* and 62*b*. Likewise, end bars 54*a* and 54*b* each include an adjustment hole 66*a* and 66*b* extending transversely therethrough and adapted to be aligned with the adjustment holes 64*a* and 64*b* when end bars 62*a* and 62*b* are slid into end bars 54*a* and 54*b* respectively. Bolts 68*a* and 68*b* are then inserted through the adjustment holes 66*a*, 66*b*, 64*a* and 64*b* to secure the inner platform section 48 to the outer platform section 50. Bolts 68*a* and 68*b* are then secured in place by nuts 70*a* and 7*b*. In this manner, the width of each bed support platform 46*a* and 46*b* may be adjusted to accommodate various size bedding. Alternatively, the above-described platform may be replaced by a solid metal plate which would provide for additional support of bedding thereon. However, due to the greatly increased weight of such a structure, it is preferred that the above described platform 46*a* and 46*b* be utilized in the present invention.

To support the inner side 72*a* and 72*b* of each bed support platform 46*a* and 46*b*, two pairs of chains 74*a*, 74*b*, 76*a* and 76*b* extend downwards from the center support beam 36 and are connected to the inner side 72*a* and 72*b* of each bed support platform 46*a* and 46*b* as shown most clearly in FIG. 1. The chains 74*a*, 74*b*, 76*a* and 76*b* may be connected to the center support beam 36 and bed support platforms 46*a* and 46*b* by any appropriate means, although it is preferred that the connection be by means of bolt and nut (not shown) to allow for relatively rapid construction and deconstruction of the lead-bearing scaffold 10 of the present invention. Of course, it is to be understood that the chains of the present invention may be replaced by steel straps, as shown in FIG. 3, or by any other appropriate tensioning member means.

It is preferred that the load-bearing scaffold 10 of the present invention be approximately seven feet ten inches in height, although this number is not critical to the present invention. Likewise, it is preferred that the width of the load-bearing scaffold 10 at the base of the scaffold be approximately equal to the room width in which the load-bearing scaffold is to be placed. This allows the load-bearing scaffold be of the present invention to utilize the base of the wall adjacent each of the first and second support structures 12 and 14 to add stability to the load-bearing scaffold 10. Also, it is preferred that each leg 18*a*, 18*b*, 20*a* and 20*b*further include a rubber foot 78*a*, 78*b*, 80*a* and 80*b* which acts to both increase friction between the base of the load-bearing scaffold 10 and the floor on which the scaffold rests and also decrease damage to the floor on which the load-bearing scaffold 10 is placed.

Figure 5:
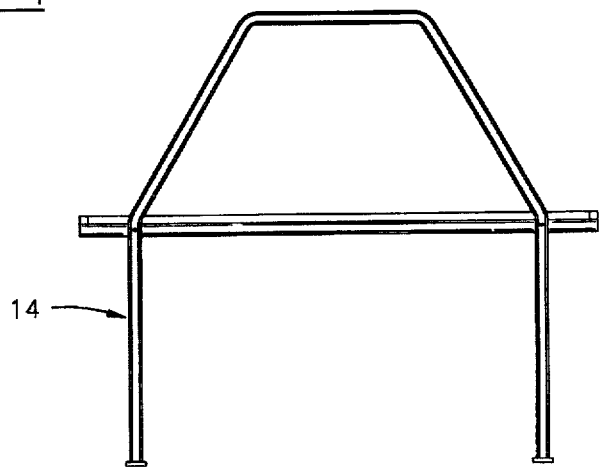
FIGS. 5 and 6 are elevational views exhibiting alternative shapes for the support structure of the present invention.
Figure 6:
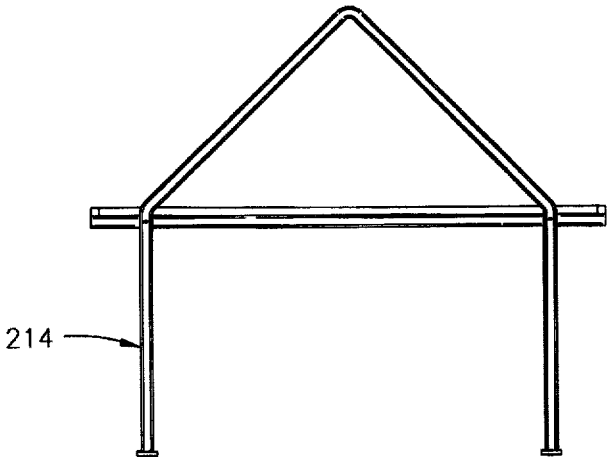

Finally, FIGS. 5 and 6 exhibit alternative shapes 114 and 214 for the first and second support structures 12 and 14. These illustrations demonstrate that while the above-described invention has been described in connection with a generally A-shaped frame support structure, the use of such a A-shaped frame structure is not critical to the present invention. In fact, room dimensions may sometimes dictate that a different shaped support structure be used with the present invention. Therefore, it is to be understood that many different shaped support structures may be used which fall within the scope of the present invention.

Furthermore, it is be understood that while the present invention may be modified in many ways, such as through the use of different materials or modification of the shape and size of the invention, the above description is not intended in any way to limit the scope of the present invention, which follows in the claims set forth below.

There has thus been set forth and described an invention which accomplishes at least all of the stated objectives.

I claim:

1. A load-bearing scaffold for placement on the floor of a room for supporting articles comprising:

first and second generally upright load-bearing support structures, each having upper sections and bases and each comprising a pair of downwardly depending legs;

only one generally horizontal beam having opposite ends, one of said ends removably mounted to said upper section of said first support structure, the other of said ends removably mounted to said upper section of said second support structure;

at least one elongated generally horizontal platform means including elongated inner and outer sides and shorter ends connected to and extended between said inner and outer sides, said outer side removably mounted to both depending legs of only one of said first and second support structures intermediate said horizontal beam and said base of said support structure whereby said inner and outer sides are arranged generally perpendicular to said generally horizontal beam; and at least two tension members extending between and connected to said horizontal beam and said platform means, said tension members depending adjacent said inner side of said platform means whereby said platform means is suspended above the floor of a room.

2. The load-bearing scaffold of claim 1 wherein each of said first and second load-bearing support structures comprise a pair of downwardly depending legs, said legs forming a general V-shape.

3. The load-bearing scaffold of claim 2 wherein said first and second support structures each further comprise a corner connector including first and second tubular leg connection sleeves having upper and lower ends and a beam connection sleeve having inner and outer ends, said first and second leg connections sleeves connected to each other at the upper ends thereof forming a V-shape, said beam connection sleeve connected to said upper end of said first and second leg connection sleeves, said beam connection sleeve extending from said first and second leg connection sleeves at an angle of at least 90°.

4. The load-bearing scaffold of claim 3 wherein said legs of said support structures each have an outer diameter slightly less than an inner diameter of said leg connection sleeves of said corner connectors, such that said legs of said support structures may be inserted into said leg connection sleeves and frictionally secured therein.

5. The load-bearing scaffold of claim 3 wherein said generally horizontal beam comprises an elongated tubular center support beam having an outer diameter slightly less than the inner diameter of said beam connection sleeves, such that said center support beam may slide within each of said beam connection sleeves.

6. The load-bearing scaffold of claim 5 wherein said center support beam further comprises a plurality of transverse adjustment holes in said center support beam, said beam connection sleeves each further including at least one transverse alignment hole, said adjustment holes and said alignment holes cooperating such that upon insertion of said beam into said beam connection sleeves, each of said alignment holes is aligned with one adjustment hole for insertion of a fastening member therethrough to secure said center support beam to said beam connection sleeves.

7. The load-bearing scaffold of claim 3 wherein said corner connectors each further comprise a T-brace having a stem and cross bar having opposite ends, said stem connected to said beam connection sleeve and said opposite ends of said cross bar each connected to one each of said leg connection sleeves such that additional structural rigidity is provided to said corner connectors.

8. The load-bearing scaffold of claim 2 wherein said horizontal platform means comprises a generally rectangular bar structure having a generally horizontal outer side bar extending between and connecting said legs, an inner side bar inwardly spaced from said outer side bar and at least two end bars extending between and connecting said inner and outer side bars.

9. The load-bearing scaffold of claim 8 wherein said end bars further comprise length adjustment means for adjusting the length of each of said end bars whereby the distance between said inner and outer side bars may be adjusted.

10. The load-bearing scaffold of claim 1 wherein said tension members comprise lengths of steel chain.

11. The load-bearing scaffold of claim 1 wherein said tension members comprise steel straps.

12. A load-bearing scaffold for placement on the floor of a room for supporting articles comprising:

first and second generally upright load-bearing support structures each having upper sections and bases and each including at least two downwardly depending legs having top sections and leg bases;

said legs of said first support structure removably connected to each other at said top sections thereof;

said legs of said second support structure removably connected to each other at said top sections thereof;

only one generally horizontal beam having opposite ends, one of said ends removably mounted to said upper section of said first support structure, the other of said ends removably mounted to said upper section of said second support structure;

at least one elongated generally horizontal platform means removably mounted on one of said first and second support structures intermediate said horizontal beam and said base of said support structure;

said platform means including elongated inner and outer sides and shorter front and rear ends, said outer side removably mounted to at least two of said legs of only one of said first and second support structures whereby said inner and outer sides are arranged generally perpendicular to said generally horizontal beam; and at least two tensioning members connected to said horizontal beam and depending downwards therefrom, said members connected to said platform means, one of said members extending between said horizontal beam and said front end adjacent said inner side, the other of said members extending between said horizontal beam and said rear end adjacent said inner side.

* * * * *